US007905223B2

(12) United States Patent
von Siegroth et al.

(10) Patent No.: US 7,905,223 B2
(45) Date of Patent: Mar. 15, 2011

(54) GUIDE CART AND POWER TOOL WITH GUIDE A CART

(75) Inventors: Stefan von Siegroth, Fellbach (DE); Joachim Hoffmann, Plochingen (DE); Sebastian Friedrich, Korb (DE); Klaus-Martin Uhl, Plochingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 310 days.

(21) Appl. No.: 12/046,491

(22) Filed: Mar. 12, 2008

(65) Prior Publication Data

US 2008/0233847 A1 Sep. 25, 2008

(30) Foreign Application Priority Data

Mar. 22, 2007 (DE) ..... 10 2007 013 705

(51) Int. Cl.
*B28D 1/04* (2006.01)

(52) U.S. Cl. ..... 125/13.01; 125/13.03

(58) Field of Classification Search ..... 125/13.01, 125/13.03, 14; 451/344, 359, 352, 353, 358; 299/39.3

See application file for complete search history.

(56) References Cited

U.S. PATENT DOCUMENTS

| | | | | |
|---|---|---|---|---|
| 2,736,311 | A * | 2/1956 | Coates | 125/14 |
| 6,349,712 | B1 * | 2/2002 | Halstead | 125/12 |
| 6,478,666 | B1 | 11/2002 | Berger et al. | |
| 7,080,851 | B2 * | 7/2006 | Schipper | 280/651 |
| 7,311,100 | B1 * | 12/2007 | Siewers | 125/13.01 |

* cited by examiner

*Primary Examiner* — Robert Rose
(74) *Attorney, Agent, or Firm* — Gudrun E. Huckett

(57) ABSTRACT

A guide cart for a hand-held power tool with a driven tool has a pivot device that is pivotable between an open position and a fixation position. A fixation elements is provided that releasably secures the power tool on the guide cart. The fixation element is secured on the pivot device. The pivot device has at least one support for supporting a tool of the power tool in the fixation position of the pivot device. The guide cart has a holder for the power tool, wherein holder is provided with a base plate and has at least one lateral guide for the power tool. The pivot device is supported on the base plate. The pivot device and the baseplate together form a C-shaped frame.

24 Claims, 3 Drawing Sheets

GUIDE CART AND POWER TOOL WITH GUIDE A CART

BACKGROUND OF THE INVENTION

The invention concerns a guide cart for a hand-held power tool with a driven tool, wherein the guide cart has at least one fixation means for releasable fixation of the power tool on the guide cart, wherein the fixation means is secured on a pivot device that is pivotable between an open position and a fixation position. The invention also relates to a power tool with a guide cart wherein the power tool has a housing in which a drive motor is arranged that drives in rotation a rotatably supported tool and wherein the power tool has at least one handle for manually guiding the power tool, wherein the guide cart has at least one fixation means for a releasable fixation of the power tool on the guide cart, and wherein the fixation means is secured on a pivot device that is pivotable between an open position and a fixation position.

U.S. Pat. No. 6,478,666 B1 discloses a guide cart for a hand-held power tool, namely for a cut-off machine, wherein, for fixation on the guide cart, the cut-off machine is inserted into an upper and a lower receptacles and is secured by a pivotable lever. The fixation of the cut-off machine by means of a pivotable lever enables a simple and quick fixation of the cut-off machine on the guide cart.

Such hand-held power tools usually have vibration damping elements with which the handles of the power tool are vibration-decoupled from the drive motor and the tool. When the power tool is secured on the guide cart on a component that is vibration-decoupled relative to the tool, an imprecise guiding action of the tool may result. The tool can vibrate as a result of the vibrations occurring in operation. These vibrations cannot be compensated as a result of the vibration decoupling of the tool relative to the guide cart.

SUMMARY OF THE INVENTION

It is an object of the invention to provide a guide cart for a hand-held power tool with which an excellent guiding action of the power tool is enabled. A further object of the invention resides in providing a power tool with a guide cart that can be guided excellently.

This object is solved by a guide cart and a power tool with a guide cart in that the pivot device has at least one support for supporting the tool of the power tool in the fixation position of the pivot device.

In that the pivot device of the guide cart not only has at least one fixation means for fixation of the power tool but also at least one support for supporting the tool of the power tool, a direct support action of the tool relative to the guide cart is achieved. The support of the tool in this connection is a support of the bearing of the tool so that the rotating movement of the tool is not impaired. By means of the support the cutting forces resulting in operation can be compensated partially so that a beneficial force introduction into the guide cart is provided. In that the fixation means as well as the support are arranged on the pivot device, the pivot movement of the pivot device causes the fixation means as well as the support to be arranged on the power tool. In this way, a simple and fast fixation of the power tool on the guide cart is achieved. A separate fixation of a support for the tool is not required.

In hand-held power tools, in particular cut-off machines, the tool, i.e., in particular the cut-off wheel, can be secured in different positions on the power tool. In order to enable in any position of the tool a supporting action, it is provided that the support is releasably secured on a transverse bracket wherein the transverse bracket has means enabling securing of the support on the transverse bracket in at least two positions. When retooling the power tool, in the case of a cut-off machine e.g. moving the cut-off wheel from a central position into an external position on an extension arm of the cut-off machine, the support can also be adjusted to a different position so that it is ensured that, when the pivot device is pivoted into the fixation position, the support will come to rest against a component connected to the tool or the bearing of the tool and supports the tool in this way.

Advantageously, the guide cart has at least one locking means for locking the pivot device in the fixation position. Advantageously, the locking means is secured on the pivot device and interacts in the locked position with the power tool and provides a fixation means for the power tool. The locking means thus fulfills two functions. It ensures on the one hand locking of the pivot device and on the other hand it secures the locking means in the locked position of the power tool on the guide cart. Advantageously, the locking means is a locking lever that is pivotably secured on the pivot device. Advantageously, the locking lever is pivotable about a pivot axis that is approximately parallel to the pivot axis of the pivot device.

It is provided that the pivot device is pivotable about a pivot axis that is transversely positioned relative to the traveling direction of the guide cart. Advantageously, the pivot axis of the pivot device is approximately horizontal. By means of the approximately horizontal position of the pivot axis of the pivot device, the pivot device can be pivoted across the power tool. As a result of this pivot direction, the support for the tool can be moved in a simple way into its position.

In order to achieve a simple insertion of the power tool on the guide cart, it is provided that the guide cart has a holder for the power tool wherein the holder is designed such that the power tool in the open position of the pivot device is insertable into the holder and removable from the holder. For fixation of the power tool on the guide cart, the power tool must only be inserted into the holder in the open position of the pivot device and, subsequently, the pivot device must be pivoted into the fixation position. The locking lever is pivoted for locking. Further measures for the fixation of the power tool on the guide cart are not required.

Expediently, the holder comprises at least one holding pin. The power tool can be placed in a simple way onto a holding pin. The holding pin secures the power tool in all radial directions of the holding pin. An additional fixation must be provided only in the longitudinal direction of the holding pin. This fixation can be realized by means of the fixation means arranged on the pivot device. For this purpose, it is provided that the pivot device and the holder define a receiving space for the power tool and that at least one fixation means of the pivot device is arranged on the side of the receiving space opposite the holding pin. The fixation means that is positioned opposite the holding pin prevents that the power tool will slip off the holding pin in the longitudinal direction of the holding pin. In all other directions the power tool is secured by the holding pin. In this way, a simple configuration is provided.

Advantageously, the pivot device comprises a bow that extends across the receiving space for the power tool in the fixation position. The bow can be of a simple design. On the bow all fixation means and all locking means can be secured. The bow moreover can ensure the accessibility of further operating elements of the power tool. It is provided that the pivot device is supported on the side of the receiving space for the power tool that is positioned to the rear in the traveling direction of the guide cart. The pivot device is then pivoted forwardly, i.e., usually toward the tool of the power tool.

Advantageously, the holder is provided on a base plate and comprises at least one lateral guide for the power tool. The lateral guide facilitates insertion of the power tool into the holder. An additional securing action of the position of the power tool is achieved. Advantageously, the pivot device is supported on the base plate and forms together with the base plate a C-shaped frame. The frame-like configuration leads to a stable design and excellent introduction of forces of the power tool into the guide cart. The C-shaped frame can be realized in a simple way and with only a few components so that a simple configuration results.

Advantageously, the pivot device has at least one actuator for an operating element of the power tool. When forwardly pivoting the pivot device, the actuator for the operating element of the power tool can thus also be pivoted into a position for operating the operating element. An additional fixation of the actuator on the power tool is thus not required. In particular, an actuator is supported pivotably about a pivot axis that extends in the travel directions of the guide cart. In this way, the actuator can be pivoted against the power tool laterally and can actuate the operating element.

For a power tool with a guide cart wherein the power tool has a housing in which a drive motor is arranged that rotatingly drives a tool that is rotatably supported and wherein the power tool has at least one handle for manually guiding the power tool, wherein the guide cart has at least one fixation means for a releasable fixation of the power tool on the guide cart and wherein the fixation means is secured on a pivot device that is pivotable between an open position and a fixation position, it is provided that the pivot device has at least one support that supports the tool of the power tool in the fixation position of the pivot device.

By supporting the tool, the cutting forces resulting in operation can be compensated and introduced directly into the guide cart. By arranging the support on the pivot device, the pivot device upon pivoting of the pivot device can be moved toward the tool so that a separate mounting of the support is not required. In this way, the power tool can the secured in a simple way on the guide cart with only a few manipulations.

It is provided that the handle is supported so as to be vibration-decoupled relative to the drive motor of the power tool and that a fixation means of the pivot device in the fixation position interacts with the handle. In that the fixation means interacts with the handle, a force introduction into the power tool can be achieved that is similar to the force introduction in manual operation. In manual operation the forces are primarily introduced through the handle. In this way, an excessive loading of other components, in particular housing components, is avoided. The handle that interacts with the fixation means is in particular a grip pipe.

Advantageously, the guide cart has a locking lever that is pivotably supported on the pivot device. In particular, the locking lever interacts with the grip pipe of the power tool. Advantageously, the locking lever has a receptacle for the grip pipe; the receptacle locks on the grip pipe in the locked position of the locking lever. In that the locking lever locks on the grip pipe, a simple and safe locking action of the pivot device is provided. The pivot device can be locked quickly and easily on the grip pipe. Advantageously, the locking lever is pivotably supported about a pivot axis that extends approximately parallel to the pivot axis of the pivot device. The pivot axis is thus also positioned parallel to the longitudinal direction of the grip pipe so that pivoting of the locking lever is possible in a simple way.

It is provided that the guide cart has a base plate on which a holder for the power tool is provided wherein the pivot device and the base plate together with the grip pipe define a closed frame when the pivot device is in the fixation position. The closed frame comprised of the grip pipe, the base plate, and the pivot device enables a direct introduction of the cutting forces into the guide cart. As a result of the closed configuration a stable and simple construction is provided. In that the grip pipe of the power tool is utilized in order to provide a closed frame, the configuration of the guide cart is simplified. The guide cart has minimal weight. Advantageously, the holder comprises at least one holding pin onto which the power tool is pushed. In this way, the power tool can be simply inserted into the holder or can be simply removed from the holder. The holding pin is advantageously arranged adjacent to a lower section of the grip pipe and the locking lever engages in particular the opposite upper section of the grip pipe. In this way, the grip pipe is secured with opposite sections on the guide cart. Forces of the power tool can be dissipated directly into the guide cart. In this way, the forces acting on the housing of the power tool can be kept at a minimum.

Advantageously, the pivot device has a fixation means resting against the power tool on the side of the power tool opposite the holding pin. In this way, it can be prevented that the power tool can slip accidentally off the holding pin. The fixation means is pivoted into engagement in particular together with the pivot device.

It is provided that the pivot device has a bow that extends above the power tool approximately parallel to the longitudinal center axis of the power tool. Advantageously, the power tool has a handle that extends in the direction of the longitudinal center axis of the power tool. The handle is in particular an upper handle that extends on the top side of the power tool. However, it can also be provided that the handle is a rear handle. The longitudinal center axis of the bow has in plan view onto the power tool in particular a spacing relative to the center axis of the handle. It is provided that on the handle extending in the direction of the longitudinal center axis of the power tool an operating element for the power tool is arranged and that the bow has an actuator for the operating element that is pivotably supported about a pivot axis that is approximately parallel to the longitudinal center axis of this handle and, in a plan view onto the power tool, is positioned adjacent to this handle. By the lateral displacement between the bow and the handle or the lateral displacement between the pivot axis of the actuator for the operating element and the handle, the actuator can pivot laterally into engagement relative to the operating element. When pivoting the pivot device, the actuator is positioned adjacent to the handle and does not impair the pivoting action for engagement and the pivoting action for disengagement. In this way, the actuator can be secured fixedly on the pivot device. A separate fixation of the actuator for the operating element is not required.

Advantageously, on the handle extending in the direction of the longitudinal center axis of the power tool a locking device for the operating element is arranged. The pivot device has advantageously an actuator for the locking device that actuates the locking device in the fixation position of the pivot device. This actuator is also arranged on the locking device when the pivot device is pivoted so that in this case there are also no additional mounting steps required. After pivoting and locking of the pivot device the power tool is immediately operative.

DESCRIPTION OF PREFERRED EMBODIMENTS

Figure 1:
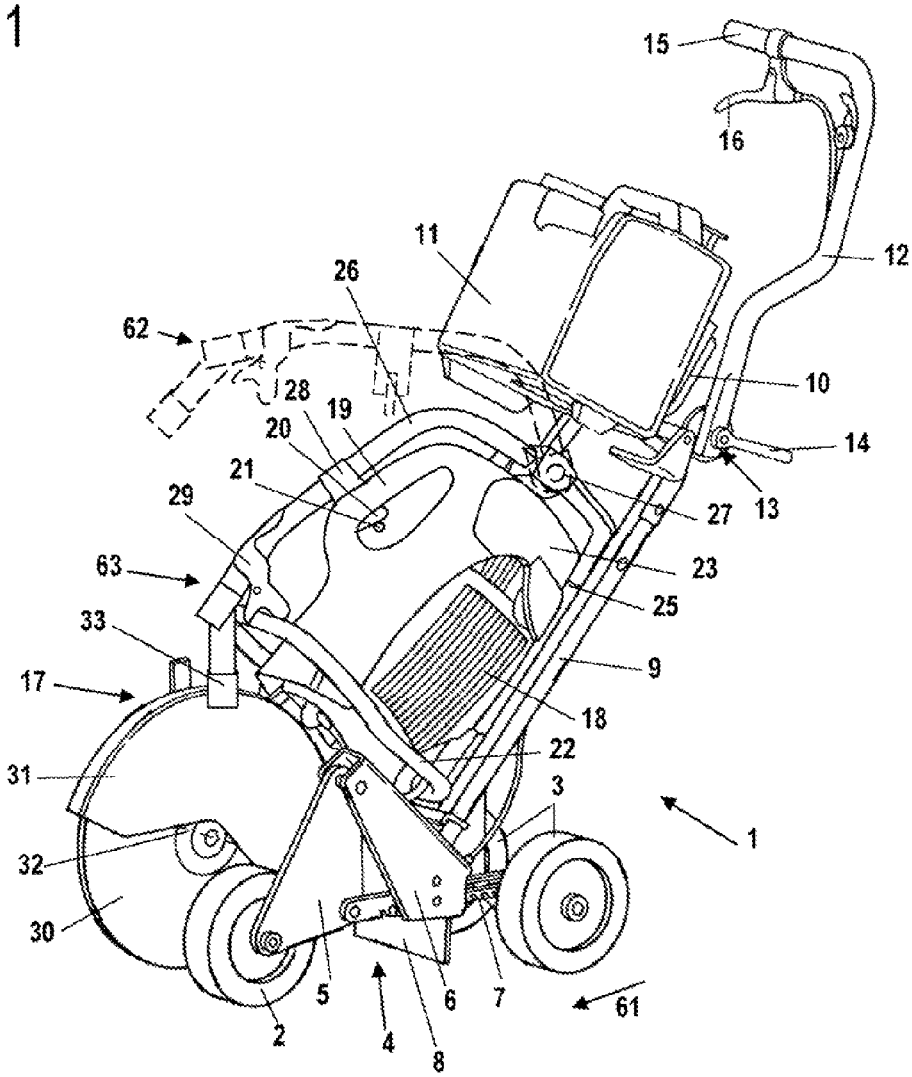
FIG. 1 shows a schematic perspective illustration of a guide cart with power tool arranged thereon.

On the guide cart 1 illustrated in FIG. 1 a hand-hand power tool, i.e., a cut-off machine 17, is secured. The invention can also be utilized in connection with a guide cart for a different hand-held power tool. The cut-off machine 17 has a housing 18 on which handles (an upper handle 19 and a grip pipe 22) are secured. By means of the upper handle 19 and the grip pipe 22 the cut-off machine 17 can be manually guided by the operator. In order to be able to produce straight cuts in a simple way, the cut-off machine 17 is secured on the guide cart 1. The guide cart 1 has a front wheel 2 and two rear wheels 3 by means of which the guide cart 1 is pushed across the ground in the traveling direction 61.

The guide cart 1 has a base frame 9 on which the two rear wheels 3 are secured. The front wheel 2 is connected to the base frame 9 by an adjusting device 4 that comprises a first stay 5, a second stay 6, as well as a locking strip 7. By means of the locking strip 7 the angle defined by the stays 5 and 6 can be changed. This causes the spacing between the front wheel 2 and the lower part of the base frame 9 to which the cut-off machine 17 is secured to be changed. By means of the adjusting device 4 the cutting depth of the cut-off machine 17 can thus be adjusted.

The cut-off machine 17 has a cut-off wheel 30 that is rotatingly driven about axis of rotation 32. The cut-off wheel 30 is partially covered about its circumference by a protective cover 31. The protective cover 31 extends on a side of the cut-off wheel 30 facing away from the ground. A splash guard 8 is arranged on the base frame 9 of the guide cart 1 behind the cut-off wheel 30 in the traveling direction 61.

On the upwardly projecting side of the base frame 9 a holder 10 is secured on which a water tank 11 is detachably arranged. On the upwardly projecting end of the base frame 9 a handle bar 12 is secured on a pivot bearing 13. The pivot bearing 13 can be released or secured by means of a fixation lever 14. In this way, the height of a handle bar section 15 arranged on the handle bar 12 can be adjusted in order to enable economic working for the operator. On the handle bar section 15 an actuating grip 16 is provided which enables actuation of a throttle lever 20 of the cut-off machine 17 from the handle bar section 15. For this purpose, on the throttle lever 20 a throttle lever actuator 21 of the guide cart 1 is provided whose function will be explained in the following in more detail.

Figure 5:
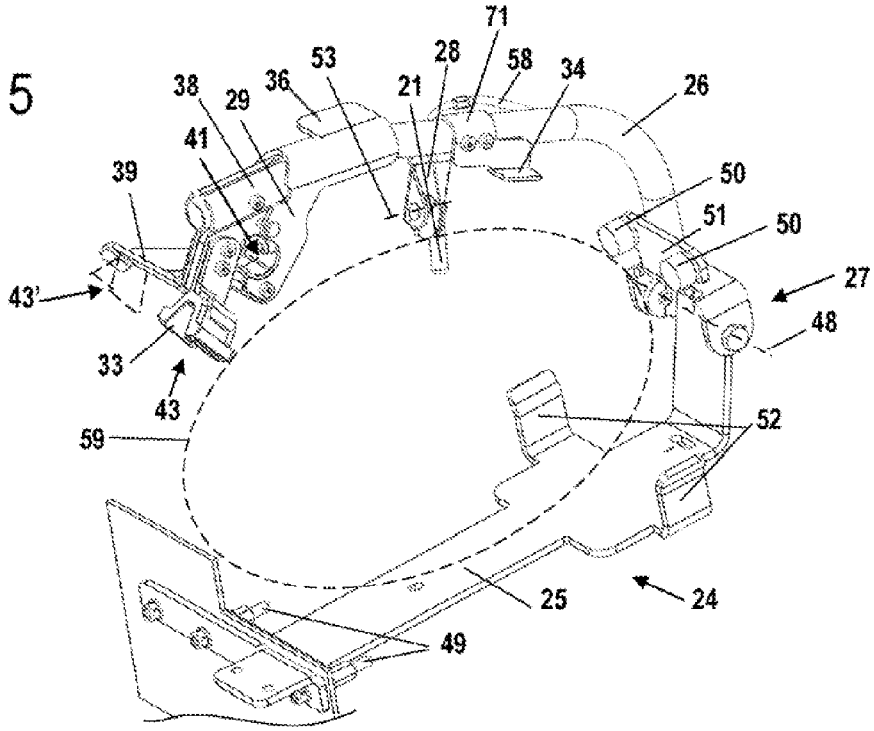
FIG. 5 is a perspective illustration of base plate and bow of the guide cart.

For the fixation of the cut-off machine 17 on the guide cart 1 a C-shaped frame is arranged on the guide cart 1 and is illustrated in FIG. 5 in a perspective view. As shown in FIGS. 1 and 5, the C-shaped frame has a base plate 25 on which a bow 26 is pivotably supported about pivot axis 48. As shown in FIG. 1, the base plate 25 rests on the base frame 9 of the guide cart 1. The baseplate 25 can be screwed onto the base frame 9. The bow 26 is pivotable between the fixation position 63 illustrated in solid lines in FIG. 1 and the open position 62 illustrated in dashed lines in FIG. 1. For this purpose, a pivot bearing 27 is provided on the base plate 25 on the rearward side of the base plate 25 in the traveling direction 61. On the bow 26 a bearing plate 28 for the throttle lever actuator 21 is secured. Moreover, on the bow 26 a locking lever 29 is pivotably supported as a fixation means. The locking lever 29 interacts in the locked position illustrated in FIG. 1 with the grip pipe 22. Moreover, on the bow 26 a support 33 for the protective cover 31 of the cut-off wheel 30 is secured. By means of the protective cover 31 the cut-off wheel 33 is thus supported relative to the guide cart 1. The bow 26 and the elements secured on the bow 26 form a pivot device. Instead of the bow 26 the pivot device can also be comprised of other pivotably supported components such as plates, supports or the like on which the other elements are secured.

Figure 2:
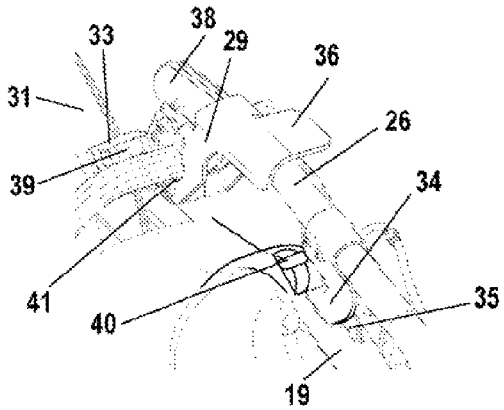
FIG. 2 is a perspective detail illustration of the position of the bow of the guide cart on the power tool.
Figure 3:
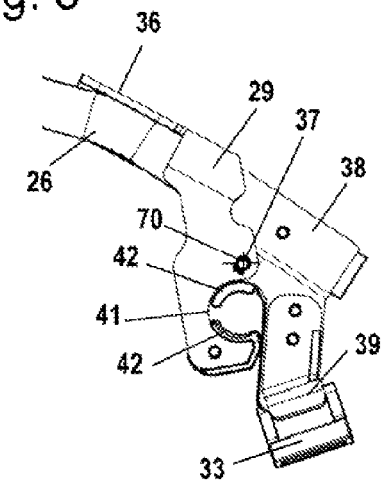
FIG. 3 is a detail side view of the bow with locking lever and support.

The FIGS. 2 and 3 illustrate the locking lever 29 and the support 33 on the bow 26. As shown in these Figures, a holder 38 is arranged in the front area of the bow 26 that is remote from the pivot bearing 27. On the holder 38 a transverse bracket 39 is secured on which the support 33 is mounted. This is also shown in FIG. 5. The transverse bracket 39 extends transversely, in particular perpendicularly to the traveling direction 61. Behind the support 33 provided on the holder 38, when viewed In the traveling direction 61, the locking lever 29 is pivotably supported on the pivot bearing 37 about pivot axis 70. The pivot axis 70 is positioned transversely, in particular perpendicularly, to the longitudinal direction of the bow 26. On the locking lever 29 a receptacle 41 is provided in which the grip pipe 22 will come to rest in the locked position of the locking lever 29. The receptacle 41 engages the grip pipe 22 by more than 180 degrees. In this way, the receptacle 41 snaps into place on the grip pipe 22. The receptacle 41 opens in the forward direction relative to the traveling direction 61. The receptacle 41 has a liner 42 that protects the grip pipe 22 from becoming damaged. The liner 42 does not extend across the entire circumference of the receptacle but only across several sections. For actuating the locking lever 29, an actuating section 36 is provided on the locking lever 29 and projects in the traveling direction 61 to the rear. In the locked position the actuating section 36 rests on the bow 26 and projects laterally past the bow 26. In this way, the locking lever 29 can be released in a simple way.

As shown in FIG. 2, the cut-off machine 17 has an upwardly projecting locking device in the form of a locking lever 35 at the upper handle 19. The locking lever 35 prevents accidental actuation of the throttle lever 20. When the locking lever 35 is not pressed down, the throttle lever 20 is blocked. On the bow 26 a locking lever actuator 34 is arranged that pushes the locking lever 35 downwardly in the pivoted engaged state of the bow 26 and in this way releases the locking action. The cut-off machine 17 has a further operating element 40 that, for example, is provided for actuating a decompression valve or a purger. The bow 26 is guided in such a way across the housing 18 of the cut-off machine 17 that the operating element 40 is easily accessible for the operator.

Figure 4:
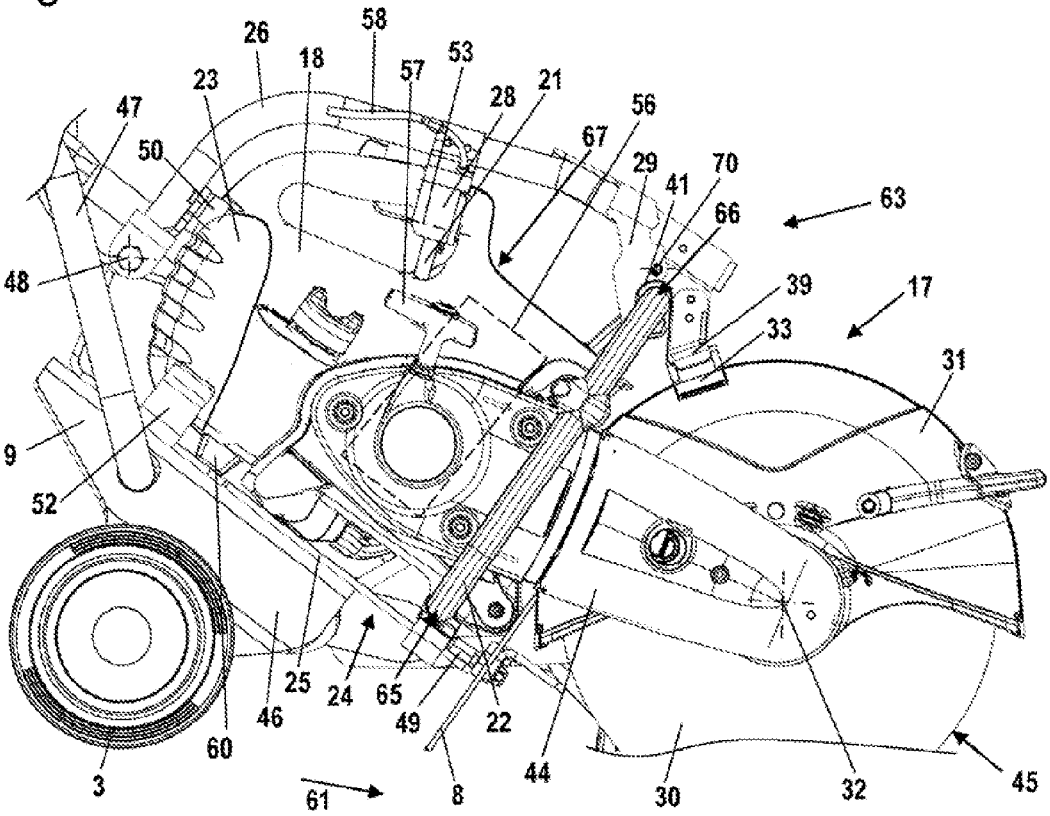
FIG. 4 is a detail illustration of a cut-off machine on the guide cart in a side view.

In FIG. 4, the cut-off machine 17 is illustrated in detail on the guide cart 1. In the housing 18 of the cut-off machine 17 a drive motor 56 is arranged which is embodied as an internal combustion engine, in particular as a two-stroke engine. The drive motor 56 however can also be a four-stroke engine. The drive motor can also be an electric motor. For starting the drive motor 56 a starter device is provided whose starter handle 57 projects outwardly from the housing 18. On the housing 18 an extension arm 44 is secured having at one end the starter device. On the other end that faces forwardly in the traveling direction 61, the cut-off wheel 30 is supported. In the illustrated embodiment, the cut-off wheel 30 is secured on the inner side of the extension arm 44. It is possible to arrange the cut-off wheel 30 on the outer side of the extension arm 44. For this purpose, the extension arm must be remounted.

In FIG. 4, an arrow 45 illustrates the cutting forces acting in operation on the cut-off wheel 30. These cutting forces are at least partially compensated by support 33 through the protective cover 31. The cutting forces are introduced in this connection via the bearing of the cut-off wheel 30 into the protective cover 31.

The basic frame 9 of the cut-off machine 1 comprises a bearing plate 46 on which a beam 47 is arranged. The beam 47 is in particular configured as a U-shaped frame that is open toward the bearing plate 46. On the bearing plate 46 the base plate 25 is secured. As shown in FIG. 5, the base plate 25 has leading and trailing ends that are upwardly bent. In the leading area, two holding pins 49 are secured that project to the rear opposite to the traveling direction 61 and parallel to the central area of the baseplate 25. On the rearward area of the base plate 25 two lateral guides 52 are secured. The base plate 25 with its two holding pins 49 and the lateral guides 52 forms a holder 24 into which the cut-off machine 17 can be inserted. For this purpose, the cut-off machine 17 is placed with an area of the housing 18 that is adjacent to the lower section 65 of the grip pipe 22 onto the holding pins 49. The lateral guides 52 are then positioned laterally relative to air filter cover 23 of the cut-off machine 17. The cut-off machine 17 has a leg 60 that is supported on the base plate 25.

For securing the cut-off machine 17 in the holder 24, the bow 26 is pivoted into the fixation position 63 illustrated in FIGS. 4 and 5. Adjacent to the pivot bearing 27 two abutments 50 are arranged on the bow 26 as a fixation element and supported by means of a holding plate 51 on the bow 26. The two abutments 50 rest against the side of the cut-off machine 17 which side is opposite the holding pins 49 and located rearwardly in the traveling direction 61 in the area of an air filter cover 23 of the cut-off machine 17. The abutments 50 force the cut-off machine 17 onto the holding pins 49 so that the cut-off machine 17 is prevented from slipping off the holding pins 49. In this way, the abutments 50 provide fixation means for the cut-off machine 17. The abutments 50 can be made from elastic material, for example, rubber or foam material.

In FIGS. 4 and 5, the throttle lever actuator 21 is also illustrated. The throttle lever actuator 21 is embodied as a pin that is pivotably supported about axis 53. As shown in FIG. 4, the pivot axis 53 extends parallel to the traveling direction 61, i.e., parallel to the plane of the cut-off wheel 30. For the actuating action, a Bowden cable 58 is provided that is connected to the actuating grip 16 shown in FIG. 1. Actuation of the actuating grip 16 effects pivoting of the throttle lever actuator 21 underneath the throttle lever 20 and upon further actuation pressure is applied onto the throttle lever 20. The throttle lever actuator 21 is supported on holder 71. The holder 71 is fixedly connected to the bow 26. On the holder 71 the locking lever actuator 34 is also provided.

As shown in FIG. 5, the base plate 25 and the bow 26 form a C-shaped frame. This C-shaped frame encloses a receiving space 59 in which the housing 18 of the cut-off machine 17 is arranged. The cut-off machine 17 is secured adjacent to the lower section 65 of the grip pipe 22 by means of the holding pins 49. On the opposite upper section 66 of the grip pipe 22, the grip pipe 22 is arranged in the receptacle 41 of the locking lever 29. The grip pipe 22, the base plate 25 and the bow 26 define a closed frame that surrounds the housing 18 of the cut-off machine 17. Cutting forces that are indicated by the arrow 45 in FIG. 4 are introduced by the support 33 into the closed frame. The bow 26 extends across the housing 18 on a top side 67 of the cut-off machine 17 that faces upwardly in the normal working position.

As shown in FIG. 5, the support 33 is secured on a transverse bracket 39 that extends transversely, in the shown embodiment perpendicularly, to the traveling direction 61. The support 33 is secured in a first position 43 on the transverse bracket 39. The support 33 however can also be secured in a second position 43', illustrated in dashed lines in FIG. 5, on the transverse bracket 39.

Figure 6:
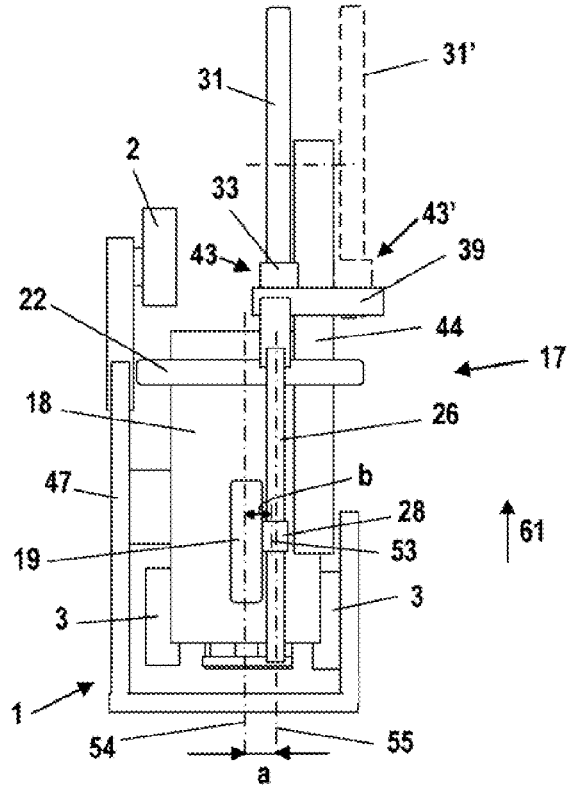
FIG. 6 is a schematic plan view of the guide car.
Figure 8:
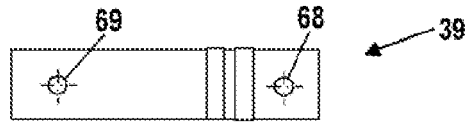
FIG. 8 is a schematic plan view onto the transverse bracket of the guide cart.

The transverse bracket 39 is shown in FIG. 8 schematically in a plan view. The transverse bracket 39 has a first bore 68 for fixation of the support 33 in the position 43 and a second bore 69 for fixation of the support 33 in the second position 43'. The support 33 is arranged in the first position 43 when the cut-off wheel 30 is arranged in the inner position as in the illustrated embodiment. When the cut-off wheel 30 is secured on the outer side of the extension arm 44 the support 33 is moved into the second position 43'. In the second position 43' the support 33 can support the protective cover 31 when the cut-off wheel 30 is arranged on the outer side of the extension arm 44. This is illustrated in FIG. 6. In this illustration the cut-off machine 17 is shown schematically on the guide cart 1 in a view from above. The protective cover 31 is illustrated with solid lines in the first position 43. The second position shows the protective cover 31' in the second position 43' in dashed lines. In this position the protective cover 31' and the cut-off wheel 30, not shown in FIG. 6, are arranged on the outer side of the extension arm 44.

As shown in FIG. 6 the housing 18 of the cut-off machine 17 in plan view has a longitudinal center axis 54 that extends parallel to the plane of the cut-off wheel 30 in the longitudinal direction of the housing 18. The longitudinal center axis 54 of the housing 18 coincides in the plan view with the longitudinal center axis 54 of the upper handle 19 that is arranged centrally on the housing 18. The bow 26 is arranged in plan view adjacent to the upper handle 19. The longitudinal center axis 55 viewed in a plan view has a spacing a to the longitudinal center axis 54. In FIG. 6 the pivot axis 53 of the throttle lever actuator 21 is illustrated also. The pivot axis 53 is arranged at a lateral spacing b to the longitudinal center axis 54. The spacing b can match the spacing a; different spacings can also be provided. By arranging the pivot axis 53 adjacent to the upper handle 19 the throttle lever actuator 21 can pivot laterally underneath the upper handle 19. The throttle lever actuator 21 does not impair the pivoting action of the bow 26.

In FIG. 6 the U-shaped configuration of the beam 47 of the base frame 9 is also shown.

Figure 7:
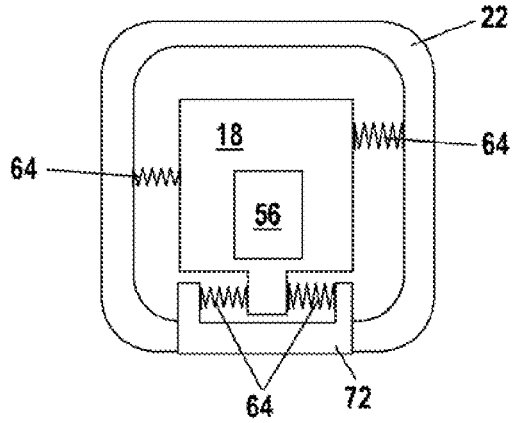
FIG. 7 is a schematic illustration of the connection of the grip pipe on the housing of the cut-off machine.

The grip pipe 22 is part of a grip frame 72 that is vibration-decoupled relative to the drive motor 56. This is illustrated schematically in FIG. 7. The grip frame 72 is connected by vibration damping elements 64 to the housing 18 of the cut-off machine 17. The vibration damping elements 64 are arranged between the grip pipe 22 and an upper area of the housing 18. Further vibration damping elements 64 are arranged in a lower area of the grip frame 72 between the grip frame 72 and the housing 18. The vibration damping elements 64 are advantageously of a soft design so that a soft connection of the grip frame 72 to the housing 18 and the cut-off wheel 30 supported by means of the extension arm 44 on the housing 18 is provided. The vibration damping elements 64 and their arrangement are only schematically illustrated in FIG. 7. A different number of vibration damping elements 64 or a different arrangement of the vibration damping elements 64 can be advantageous.

In the fixation position 63 with locking lever 29 being locked, the grip pipe 22 is fixedly secured on the bow 26 and secured relative to the holding pins 49. The cut-off wheel 30 is connected fixedly to the housing 18 by means of the extension arm 44. However, the housing 18 is connected to the grip frame 72 by vibration damping elements 64 so that the cut-off wheel 30 relative to the grip frame 72 is movable transversely to the plane of the cut-off wheel 30. In order to limit this movability or to inhibit it, the support 33 is provided that couples the cut-off wheel 30 directly with the bow 26 and in this way reduces the relative movement of the cut-off wheel 30 relative to the guide cart 1. The limitation of the movability is in particular advantageous when the grip frame 72 and the housing 18 are connected to one another by soft vibration damping elements 64. In the case of soft vibration damping elements 64 the vibrations occurring in operation can be compensated well. However, as a result of the soft design of the vibration damping elements 64 there is also a great relative movability of the cut-off wheel 30 relative to the grip frame 72. This is not advantageous in case of an arrangement of the cut-off machine on a guide cart. This great relative movability can be limited or prevented by means of the support 33. In particular for soft vibration damping elements 64 a support 33 is thus advantageous. The support 33 however can also be advantageous for power tools with rigidly designed vibration damping elements 64.

Instead of the upper handle 19 a rear handle can be provided that extends in a direction of the longitudinal axis of the power tool on a side of the housing 18 remote from the cut-off wheel 30. In this case, it is advantageous when the bow 26 extends also across the rear handle. The abutments 50 can be arranged between the locking lever 29 and the bearing plate 28 and thus at a spacing relative to the pivot axis 48 of the bow 26.

The specification incorporates by reference the entire disclosure of German priority document 10 2007 013705.4 having a filing date of Mar. 22, 2007.

While specific embodiments of the invention have been shown and described in detail to illustrate the inventive principles, it will be understood that the invention may be embodied otherwise without departing from such principles.

What is claimed is:

1. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

wherein the pivot device comprises a transverse bracket, wherein the support is releasably secured on the transverse bracket, wherein the transverse support has means that enable a fixation of the support on the transverse bracket in at least two positions.

2. The guide cart according to claim 1, comprising at least one locking means that locks the pivot device in the fixation position.

3. The guide cart according to claim 2, wherein the locking means is secured on the pivot device and in a locked position interacts with the power tool and provides the at least one fixation means for the power tool.

4. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

at least one locking means that locks the pivot device in the fixation position;

wherein the locking means is a locking lever that is pivotably secured on the pivot device, wherein the locking lever is pivotable about a pivot axis that is approximately parallel to a pivot axis of the pivot device.

5. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

wherein the pivot device is pivotable about a pivot axis that is positioned transversely to a traveling direction of the guide cart.

6. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

wherein a pivot axis of the pivot device is positioned approximately horizontally.

7. The guide cart according to claim 1, comprising a holder for the power tool, wherein the holder is designed such that in the open position of the pivot device the power tool is insertable into the holder and removable from the holder.

8. The guide cart according to claim 7, wherein the holder has at least one holding pin.

9. The guide cart according to claim 8, wherein the pivot device and the holder define a receiving space for the power tool and wherein the at least one fixation means of the pivot device is arranged on a side of the receiving space opposite the at least one holding pin.

10. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

a holder for the power tool, wherein the holder is designed such that in the open position of the pivot device the power tool is insertable into the holder and removable from the holder, wherein the holder has at least one holding pin;

wherein the pivot device and the holder define a receiving space for the power tool and wherein the at least one fixation means of the pivot device is arranged on a side of the receiving space opposite the at least one holding pin;

wherein the pivot device comprises a bow that extends in the fixation position across the receiving space for the power tool.

11. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

a holder for the power tool, wherein the holder is designed such that in the open position of the pivot device the power tool is insertable into the holder and removable from the holder, wherein the holder has at least one holding pin;

wherein the pivot device and the holder define a receiving space for the power tool and wherein the at least one fixation means of the pivot device is arranged on a side of the receiving space opposite the at least one holding pin;

wherein the pivot device is supported on a side of the receiving space for the power tool which side is positioned rearwardly in a traveling direction of the guide cart.

12. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

wherein the pivot device has at least one actuator for an operating element of the power tool, wherein the actuator is pivotably supported about a pivot axis that extends in a traveling direction of the guide cart.

13. A guide cart for a hand-held power tool with a driven tool, the guide cart comprising:

a pivot device pivotable between an open position and a fixation position;

at least one fixation means that releasably secures a power tool on the guide cart, wherein the at least one fixation means is secured on the pivot device;

wherein the pivot device has at least one support for supporting a tool of the power tool in the fixation position of the pivot device;

wherein the guide cart has a base plate and a holder for the power tool provided on the base plate, wherein the holder comprises at least one lateral guide for the power tool, wherein the pivot device is supported on the base plate, and wherein the pivot device and the base plate together form a C-shaped frame.

14. A power tool with a guide cart, wherein the power tool has a housing in which a drive motor is arranged that drives in rotation a rotatably supported tool and wherein the power tool has at least one handle for manually guiding the power tool, wherein the guide cart has a pivot device that is pivotable between an open position and a fixation position, wherein the guide cart further has at least one fixation means that releasably secures the power tool on the guide cart, wherein the at least one fixation means is secured on the pivot device, wherein the pivot device has at least one support that supports the tool of the power tool in the fixation position of the pivot device, wherein the at least one handle is supported so as to be vibration-decoupled relative to the drive motor of the power tool and wherein the at least one fixation means of the pivot device in the fixation position interacts with the at least one handle.

15. The power tool according to claim 14, wherein the at least one handle with which the at least one fixation means interacts is a grip pipe.

16. The power tool according to claim 15, wherein the at least fixation means is a locking lever that is pivotably supported on the pivot device.

17. The power tool according to claim 16, wherein the locking lever interacts with the grip pipe of the power tool, wherein the locking lever has a receptacle for the grip pipe and the receptacle is locked on the grip pipe in a locked position of the locking lever.

18. The power tool according to claim 16, wherein the locking lever is pivotably supported about a pivot axis that extends approximately parallel to a pivot axis of the pivot device.

19. The power tool according to claim 16, wherein the guide cart has a base plate and a holder for the power tool provided on the base plate, wherein the pivot device, the base plate, and the grip pipe define a closed frame when the pivot device is in the fixation position.

20. The power tool according to claim 19, wherein the holder comprises a holding pin onto which the power tool is pushed, wherein the holding pin is arranged adjacent to a lower section of the grip pipe and wherein the locking lever engages an upper section of the grip pipe that is positioned opposite to the lower section.

21. The power tool according to claim 20, wherein the at least one fixation means comprises a fixation element that rests against the power tool on a side of the power tool opposite the holding pin.

22. A power tool with a guide cart, wherein the power tool has a housing in which a drive motor is arranged that drives in rotation a rotatably supported tool and wherein the power tool has at least one handle for manually guiding the power tool, wherein the guide cart has a pivot device that is pivotable between an open position and a fixation position, wherein the guide cart further has at least one fixation means that releasably secures the power tool on the guide cart, wherein the at least one fixation means is secured on the pivot device, wherein the pivot device has at least one support that supports the tool of the power tool in the fixation position of the pivot device, wherein the pivot device comprises a bow that extends approximately parallel to a longitudinal center axis of the power tool above the power tool.

23. The power tool according to claim 22, wherein the at least one handle of the power tool extends in a direction of the longitudinal center axis of the power tool, wherein the longitudinal center axis of the bow in a plan view onto the power tool has a spacing relative to the longitudinal center axis of the at least one handle, wherein the at least one handle extending in the direction of longitudinal center axis of the power tool has an operating element for the power tool and wherein the bow has an actuator for the operating element, which actuator is pivotably supported about a pivot axis that is approximately parallel to the longitudinal central axis of the at least one handle and is positioned adjacent to the at least one handle when viewed in a plan view onto the power tool.

24. The power tool according to claim 23, wherein on the at least one handle extending in the direction of the longitudinal center axis of the power tool a locking device for the operating element is arranged and wherein the pivot device has an actuator for the locking device that actuates the locking device in the fixation position of the pivot device.

* * * * *